United States Patent [19]

Depowski

[11] 4,274,168

[45] Jun. 23, 1981

[54] PATIENT TRANSFER APPARATUS

[76] Inventor: Norma M. Depowski, 1089 Hunter Dr., Elgin, Ill. 60120

[21] Appl. No.: 75,925

[22] Filed: Sep. 17, 1979

[51] Int. Cl.[3] ..... A61G 7/10

[52] U.S. Cl. ..... 5/81 B; 5/82 R; 5/508; 414/523

[58] Field of Search ..... 5/81 R, 81 B, 81 C, 5/82, 508; 414/353, 523, 347; 108/52.1

[56] References Cited

U.S. PATENT DOCUMENTS

| | | | |
|---|---|---|---|
| 2,544,743 | 3/1951 | Vanback | 108/52.1 |
| 2,918,681 | 12/1959 | Davis | 5/81 C |
| 3,489,300 | 1/1970 | McCartney et al. | 414/347 |
| 3,541,617 | 5/1968 | Clanan | 5/81 B |
| 3,792,500 | 2/1974 | Swara, Sr. | 5/81 B |

*Primary Examiner*—Casmir A. Nunberg
*Attorney, Agent, or Firm*—Bianchi & White

[57] ABSTRACT

A patient transfer apparatus is provided which utilizes a movable cart onto which is structurally annexed an expandable series of finger-like projections fitted with rollers which, in an expanded mode may be inserted into correspondingly hollowed out areas of a hard rubber or vinyl mattress foundation which is permanently affixed to a hospital or other bed thus enabling the mattress and any patient thereon to transfer across these rollers to or from the movable cart and/or bed.

4 Claims, 3 Drawing Figures

PATIENT TRANSFER APPARATUS

BACKGROUND OF THE INVENTION

This invention relates only generally to devices previously used to move patients. Such devices include a crude roller laiden stretcher used to scoop up a patient much like a spatula scoops up a pancake. Another such device provided an elastic strap system whereby a mattress with patient lying thereon could be slid to and from a bed foundation but without controlled movements, being subject to manual restraints and guidance only, with the patient still exposed to the jostling that inevitably accompanies manual transfer. A third device provides an elaborate and expensive mobile stretcher with a movable foundation that has verticle and horizontal positions. This device, principally intended for invalids, still requires some manual manipulation of a patient user and again an injured patient is exposed to painful jostling in transferring to and from a hospital bed.

SUMMARY OF THE INVENTION

The present invention provides a unique improvement in an apparatus to transfer injured or otherwise delicate patients to and from hospital beds. The primary object of this invention achieved here for the first time, is the quick and efficient transfer of an injured patient in a hospital type setting, to and from a hospital bed without any discomfort on account of the transfer. This is accomplished by the use of a predetermined rollered path on which the mattress with patient thereon, will travel. This rollered path is made by several finger-like projections with a rollered surface. These finger-like projections are inserted under the mattress into preformed hollows in a bed foundation which may be inexpensively installed to existing hospital or other beds without major modification. The rollered projections may be easily installed in existing hospital carts in hinged or telescoping configuration, enabling the cart with projections in an extended mode to retrieve a patient on mattress via the rollered projections while these projections in retracted mode will allow the cart to pass through doorways, hallways, elevators, and other narrow places, through which an unaltered hospital cart may pass. Other objects and advantages will become apparent upon reading the following detailed description and claims, and upon reference to the accompanying drawings.

BRIEF DESCRIPTION OF THE DRAWINGS

For a more complete understanding of this invention, reference should now be made to the embodiments illustrated in greater detail in the accompanying drawings and described below by way of example of the invention.

In the drawings.

DESCRIPTION OF THE PREFERRED EMBODIMENT

Figure 1:
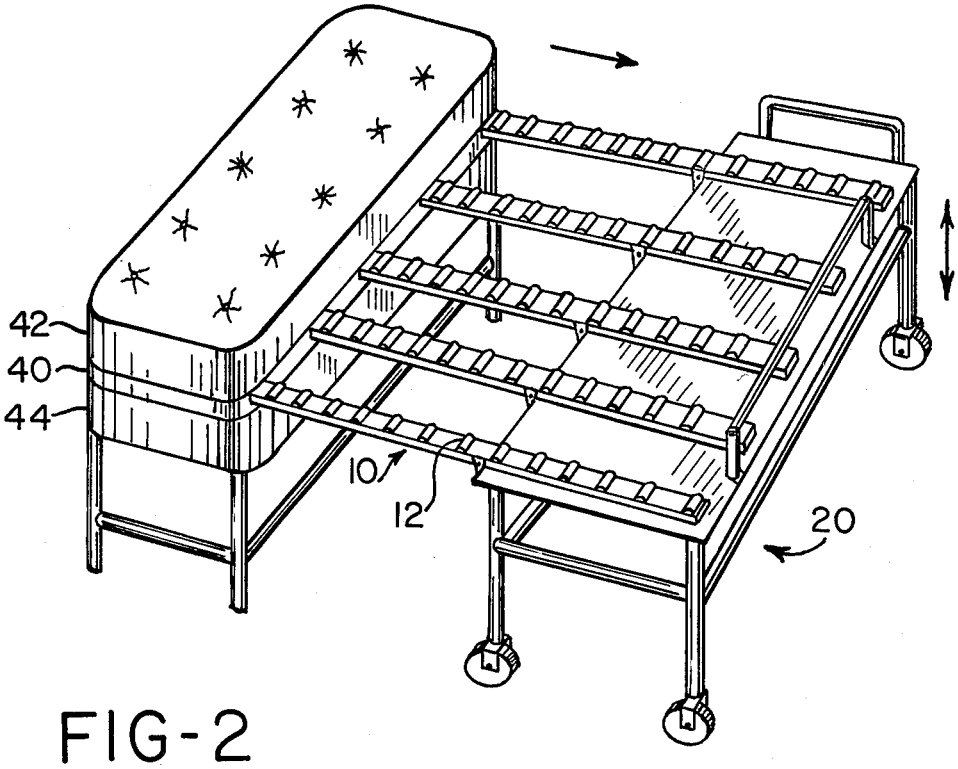
FIG. 1 is a perspective of a special hollowed out vinyl mattress foundation (isolated in FIG. 2), sandwiched between or in place of a box spring or equivalent and a mattress, into which 5 sets of rollered finger-like projections, permanently affixed to a typical hospital cart, are extended.
Figure 3:
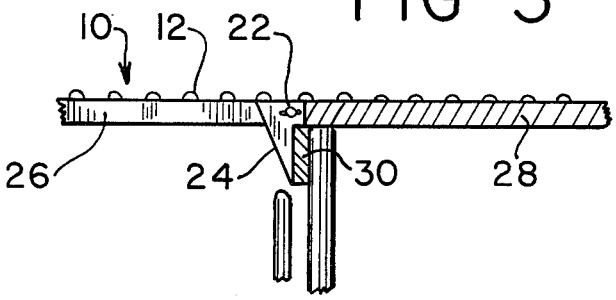
FIG. 3 is a side view of the latch mechanism located on the modified hospital cart which allows the rollered projections to be fixed in either an extended horizontal mode ready for insertion as in FIG. 1, or a retracted vertical mode resting on the side of the cart (not shown).

Referring to FIG. 1, there is shown a perspective view of the preferred embodiment of this invention. The patient transfer apparatus is comprised of a series of projections 10 across the surface of which are housed conventional rollers 12 arranged to roll freely within its housing and extending above the structure of the projection to support objects placed thereon. These projections are structurally affixed to a common hospital cart 20 and arranged to be retracted when not in use. More particularly, a pull ring assembly (see FIG. 3) allows the rollered projections to be positioned either horizontally for transport of the patient or removed out of the way while the cart is moved. The projection has attached at its junction with the cart a pinned joint 22 and a brace 24 for supporting the extending portion 26 of the rollered projection. This extending portion of the rollered projection is separable from the portion 28 affixed to the cart whereby removal of the pin at the joint 22 allows removal of the extending portion of the projection. When the extending portion is replaced and the pinned joint 22 engaged, the brace 29 locks between the pinned joint and the abutment 30 on the cart. The preferred embodiment herein described sets forth one of many equivalent means which may be employed to retract or hinge the extending portion to a storage position. Numerous other devices and methods exist in the art within the spirit and scope of this invention which provide means to hinge or retract the extending portion of the rollered projection. The same result could also be accomplished with a telescoping arrangement in which the rollered projections slide underneath the surface of the top of the cart for storage. In this mode the modified cart, with or without mattress and patient thereon may move freely through corridors narrow or otherwise that a cart not modified may negotiate.

Figure 2:
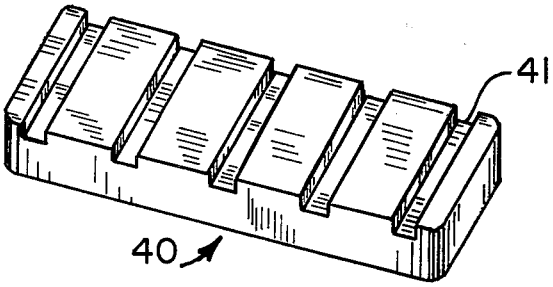
FIG. 2 is a perspective view of the special mattress foundation, into the grooves of which the rollered projections shown in FIG. 1, are inserted.

In the horizontal or extended position these rollered projections may be inserted into a mattress foundation, and FIG. 1 shows the projections in position to be inserted into the mattress foundation 40. Insertion is completed by moving the cart laterally to the bed side. This mattress foundation (see FIG. 2) consists of a hard rubber or vinyl material having grooves 41 corresponding in dimension and position with the rollered projections to allow free ingress and egress of these projections. The mattress foundation is positioned between the existing bed mattress 42 and a box spring 44 assembly comprising the base of the bed. When the projections are inserted into the foundation grooves, the rollered projections form a bridge across which the mattress with patient lying thereon are conveyed between the bed and the cart.

The foregoing specifications and drawings have shown and described means for conveying a patient between a cart and hospital bed without unduly upsetting the patient. Rollered projections which insert into a compatible mattress foundation is used and the mattress conveyed with the patient thereon. When not in operation, the projections may be removed or retracted to provide unimpeded use of the cart.

I claim:

1. An apparatus for transferring a patient on a mattress between a hospital bed base member, and a cart comprising: projections affixed to the upper surface of the cart having anti-friction means mounted thereon for conveying loads, a foundation member interposed between the bed base member and the mattress, wherein said foundation member has grooves defined therein for receiving said projections, whereby the mattress is supported by said anti-friction means on said projections when said projections are inserted into said foundation member.

2. The apparatus of claim 1 further comprising means for retracting said projections for storage within close proximity of the cart.

3. The apparatus of claim 2 wherein said anti-friction means comprises multiple rollers on said projections for conveying the mattress between the cart and bed.

4. A method of transferring a patient on a mattress between a hospital bed base member and cart comprising:

(a) positioning a cart proximate the hospital bed wherein said cart has affixed thereto horizontal projections bearing anti-friction means on the surface thereof, and wherein said projections extend sufficiently beyond the cart for positioning under the mattress on the bed base member and within foundation grooves thereunder;

(b) inserting said projection into said foundation grooves while moving the cart to the bed side; and (c) urging the mattress over the projections between terminal positions upon the cart and upon the foundation.

* * * * *